US007694361B1

(12) United States Patent
Chen

(10) Patent No.: US 7,694,361 B1
(45) Date of Patent: Apr. 13, 2010

(54) PLAYPEN HAVING A REINFORCED STRENGTH

(76) Inventor: Owen Chen, 284, Min Chuan West Rd., Tatung, Taipei (TW)

( * ) Notice: Subject to any disclaimer, the term of this patent is extended or adjusted under 35 U.S.C. 154(b) by 0 days.

(21) Appl. No.: 12/419,471

(22) Filed: Apr. 7, 2009

(51) Int. Cl.
*A47D 13/06* (2006.01)

(52) U.S. Cl. ..... 5/99.1; 5/98.1

(58) Field of Classification Search ..... 5/98.1, 5/99.1, 102, 110, 111, 174, 177–180; 256/25
See application file for complete search history.

(56) References Cited

U.S. PATENT DOCUMENTS 5,615,427 A * 4/1997 Huang ..... 5/99.1
5,991,944 A * 11/1999 Yang ..... 5/99.1
7,380,311 B2 * 6/2008 Chen ..... 16/326
7,552,487 B2 * 6/2009 Chen ..... 5/99.1
7,594,285 B2 * 9/2009 Chen et al. ..... 5/99.1

* cited by examiner

*Primary Examiner*—Michael Trettel
(74) *Attorney, Agent, or Firm*—Alan Kamrath; Kamrath & Associates PA

(57) ABSTRACT

A playpen includes a top frame including four corner connectors, and four foldable articulations mounted between the corner connectors respectively. Each of the foldable articulations includes a mounting seat disposed between any two of the corner connectors, two main rods each having a first end pivotally connected with the mounting seat and a second end pivotally connected with the respective corner connector, and two auxiliary rods each having a first end pivotally connected with the mounting seat and a second end pivotally connected with the respective corner connector. Thus, each of the main rods, the respective auxiliary rods, the mounting seat of each of the foldable articulations and the respective corner connector form a substantially parallelogram or trapezium linkage to reinforce the structural strength of the top frame.

7 Claims, 9 Drawing Sheets

PLAYPEN HAVING A REINFORCED STRENGTH

BACKGROUND OF THE INVENTION

1. Field of the Invention

The present invention relates to a playpen and, more particularly, to a foldable playpen for placing a baby or child.

2. Description of the Related Art

A conventional playpen comprises a top frame and a bottom frame located under the top frame. The top frame includes four corner connectors, four foldable articulations mounted between the corner connectors respectively, and four side support rods each having an upper end mounted on a respective one of the corner connectors. Each of the four foldable articulations includes a mounting seat disposed between any two of the corner connectors, two pivot rods each having a first end pivotally connected with the mounting seat and a second end pivotally connected with a respective one of the corner connectors, and a folding device mounted on the mounting seat and releasably locked on each of the pivot rods to releasably lock each of the pivot rods onto the mounting seat. Thus, each of the foldable articulations can be expanded and folded by operation of the folding device so as to expand and fold the top frame. However, the mounting seat of each of the foldable articulations is supported by the pivot rods only, so that the top frame has a smaller strength. In addition, the mounting seat of each of the foldable articulations is not supported by the pivot rods solidly and stably, so that each of the foldable articulations of the top frame cannot be operated exactly and smoothly, thereby greatly causing inconvenience to a user when expanding and folding the top frame.

BRIEF SUMMARY OF THE INVENTION

In accordance with the present invention, there is provided a playpen, comprising a top frame including four corner connectors, and four foldable articulations mounted between the corner connectors respectively. Each of the four foldable articulations includes a mounting seat disposed between any two of the corner connectors, two main rods each having a first end pivotally connected with the mounting seat and a second end pivotally connected with a respective one of the corner connectors, and two auxiliary rods each having a first end pivotally connected with the mounting seat and a second end pivotally connected with a respective one of the corner connectors.

The primary objective of the present invention is to provide a playpen having a reinforced strength.

Another objective of the present invention is to provide a playpen, wherein each of the main rods, the respective auxiliary rods, the mounting seat of each of the foldable articulations and the respective corner connector form a substantially parallelogram or trapezium linkage so as to reinforce the structural strength of the top frame and to enhance the lifetime of the top frame.

A further objective of the present invention is to provide a playpen, wherein the mounting seat of each of the foldable articulations is supported by the main rods and the auxiliary rods, so that each of the foldable articulations of the top frame is operated exactly and smoothly to facilitate a user expanding and folding the top frame.

A further objective of the present invention is to provide a playpen, wherein the side support rods are supported solidly and stably by the main rods and the auxiliary rods of each of the foldable articulations so that the side support rods will not be inclined or tilted to prevent the playpen from being collapsed or upset.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
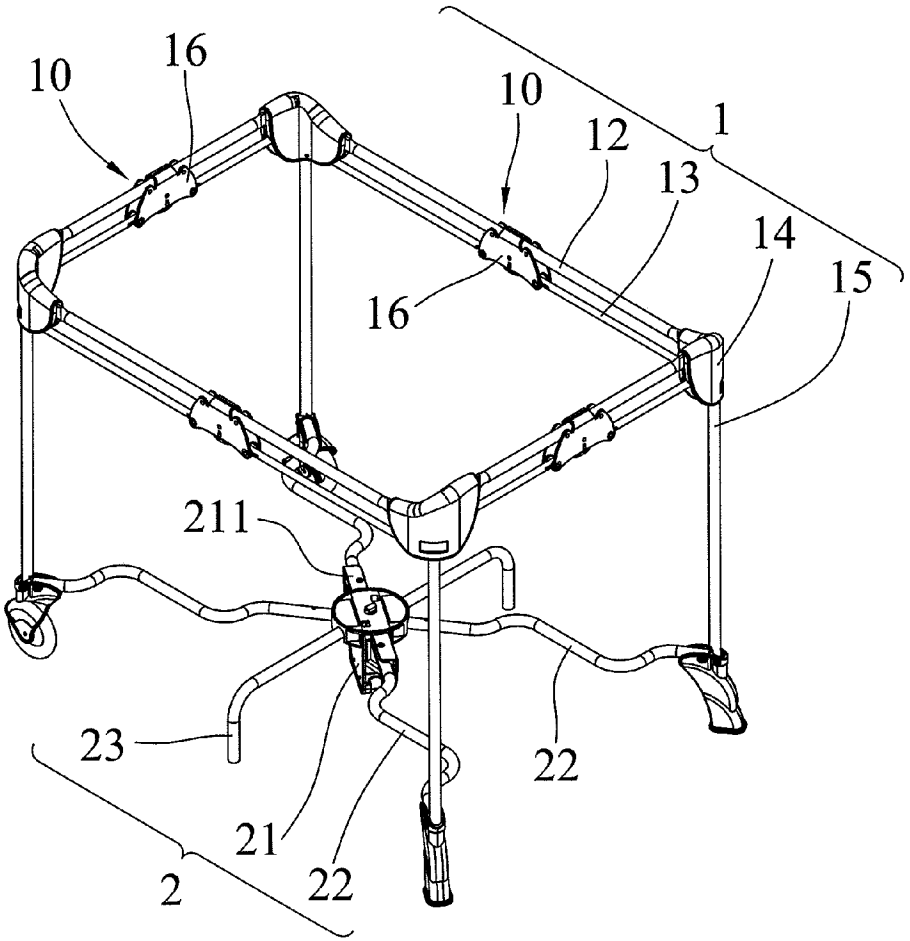
FIG. 1 is a perspective view of a playpen in accordance with the preferred embodiment of the present invention.

Referring to the drawings and initially to FIGS. 1-5, a playpen in accordance with the preferred embodiment of the present invention comprises a top frame 1 and a bottom frame 2 located under the top frame 1.

The top frame 1 includes four corner connectors 14, four foldable articulations 10 mounted between the corner connectors 14 respectively, and four side support rods 15 each having an upper end mounted on a respective one of the corner connectors 14.

Each of the four foldable articulations 10 includes a mounting seat 16 disposed between any two of the corner connectors 14, two main rods 12 each having a first end pivotally connected with the mounting seat 16 and a second end pivotally connected with a respective one of the corner connectors 14, two auxiliary rods 13 each having a first end pivotally connected with the mounting seat 16 and a second end pivotally connected with a respective one of the corner connectors 14, and a folding device 11 mounted on the mounting seat 16 and releasably locked on each of the main rods 12 to releasably lock each of the main rods 12 onto the mounting seat 16.

Each of the main rods 12 of each of the foldable articulations 10 is located at a top of the mounting seat 16, and each of the auxiliary rods 13 of each of the foldable articulations 10 is located at a bottom of the mounting seat 16. Each of the auxiliary rods 13 of each of the foldable articulations 10 is located under and parallel with a respective one of the main rods 12. Thus, each of the main rods 12, the respective auxiliary rods 13, the mounting seat 16 of each of the foldable articulations 10 and the respective corner connector 14 form a substantially parallelogram or trapezium linkage.

The folding device 11 of each of the foldable articulations 10 includes two locking members 111 each pivotally mounted in the mounting seat 16 and each having a first end 115 detachably rested on a respective one of the main rods 12 to position the respective main rod 12 on the mounting seat 16, a press button 113 movably mounted on the mounting seat 16 and movable between the two locking members 111, a push member 114 secured on the press button 113 to move with the press button 113 and rested on a second end 116 of each of the locking members 111, and an elastic member 112 mounted on the mounting seat 16 and biased between the first ends 115 of the two locking members 111 to provide a restoring force to the locking members 111.

The second end 116 of each of the locking members 111 is a ramp rested on the push member 114. Thus, when the second end 116 of each of the locking members 111 is pushed by the push member 114 to move outward relative to the mounting seat 16, the locking members 111 are pivoted relative to the mounting seat 16 so that the first end 115 of each of the two locking members 111 is moved inward relative to the mounting seat 16 to detach from the respective main rod 12. The press button 113 is a substantially inverted T-shaped block and protrudes outward from the mounting seat 16. The elastic member 112 is a substantially V-shaped torsion spring and has two legs each urged on the first end 115 of the respective locking member 111.

The bottom frame 2 includes a support seat 21, two sector-shaped fixing plates 211 pivotally mounted on two opposite ends of the support seat 21, a rotation seat 212 rotatably mounted in the support seat 21 and having two opposite ends that are moveable to abut the fixing plates 211 to position the fixing plates 211 on the support seat 21, a pull tab 213 movably mounted on a top of the support seat 21 and connected with an upper end 214 of the rotation seat 212 to drive the rotation seat 212 to rotate relative to the support seat 21, two support bars 23 each pivotally mounted on the support seat 21, and four bottom bars 22 each having a first end pivotally mounted on the support seat 21 and a second end pivotally connected with a lower end of a respective one of the side support rods 15 of the top frame 1. Two of the bottom bars 22 of the bottom frame 2 are secured on the fixing plates 211 to move with the fixing plates 211.

Figure 2:
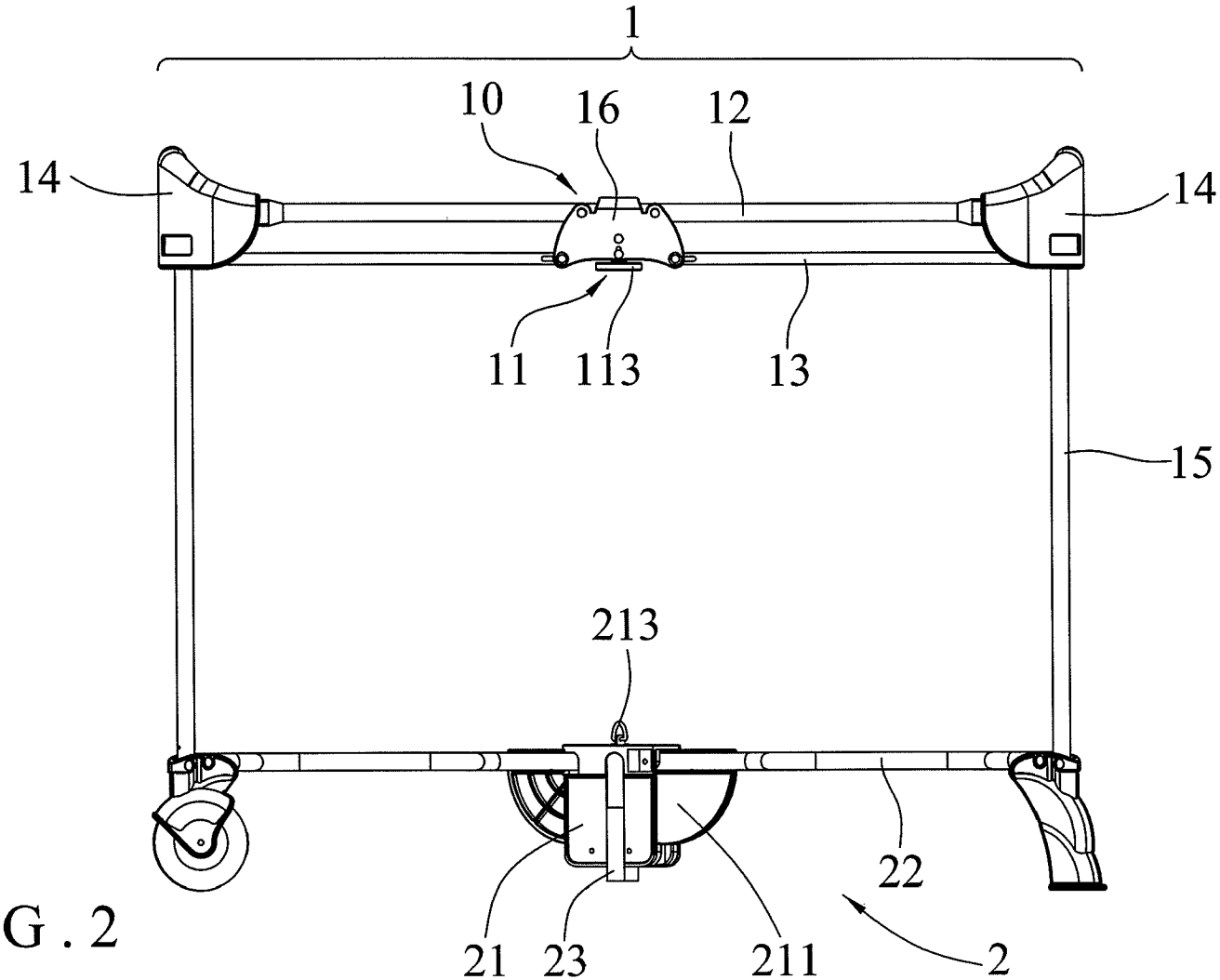
FIG. 2 is a front view of the playpen as shown in FIG. 1.
Figure 3:
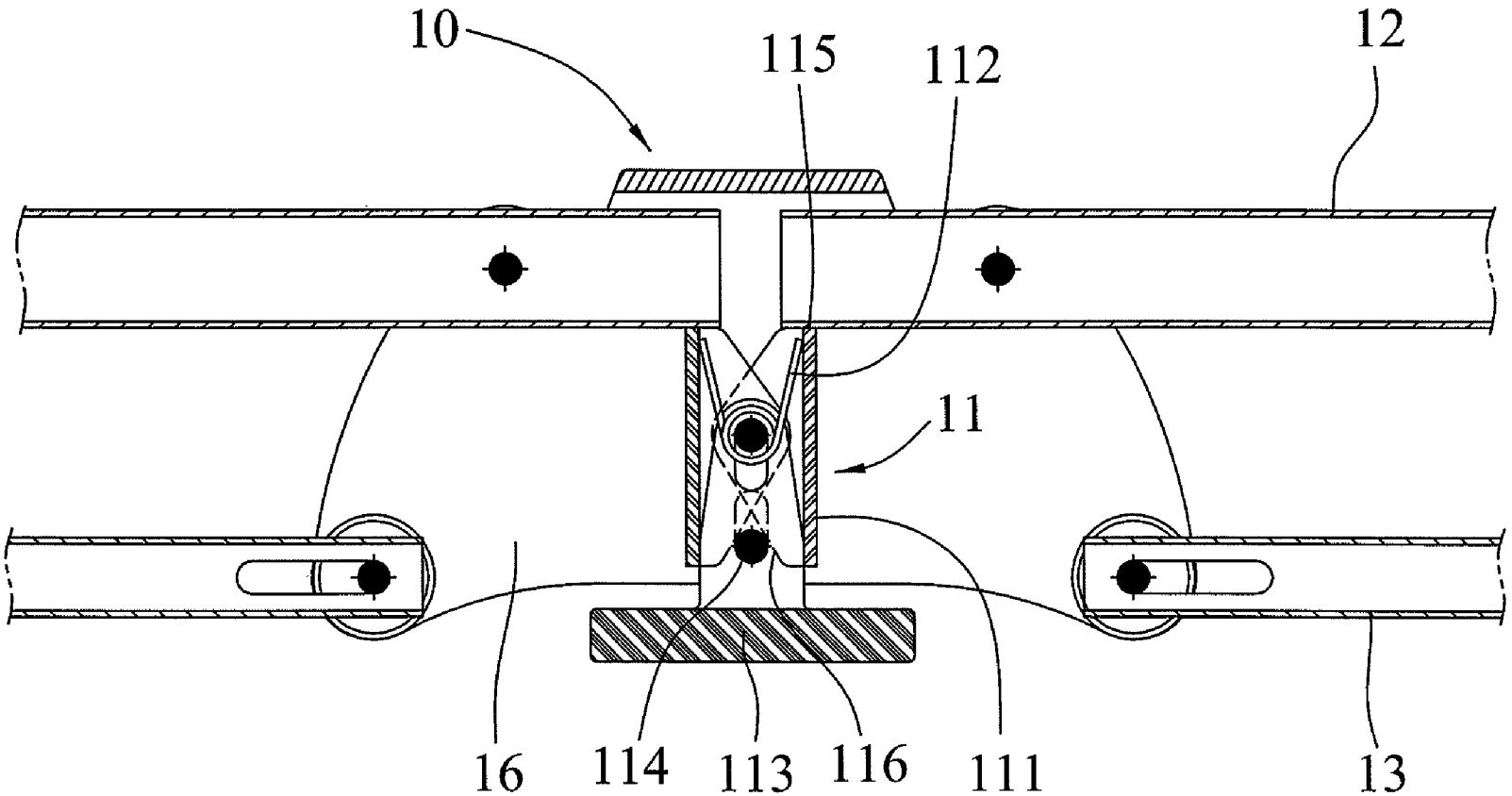
FIG. 3 is a partially front cross-sectional view of a top frame of the playpen as shown in FIG. 1.
Figure 4:
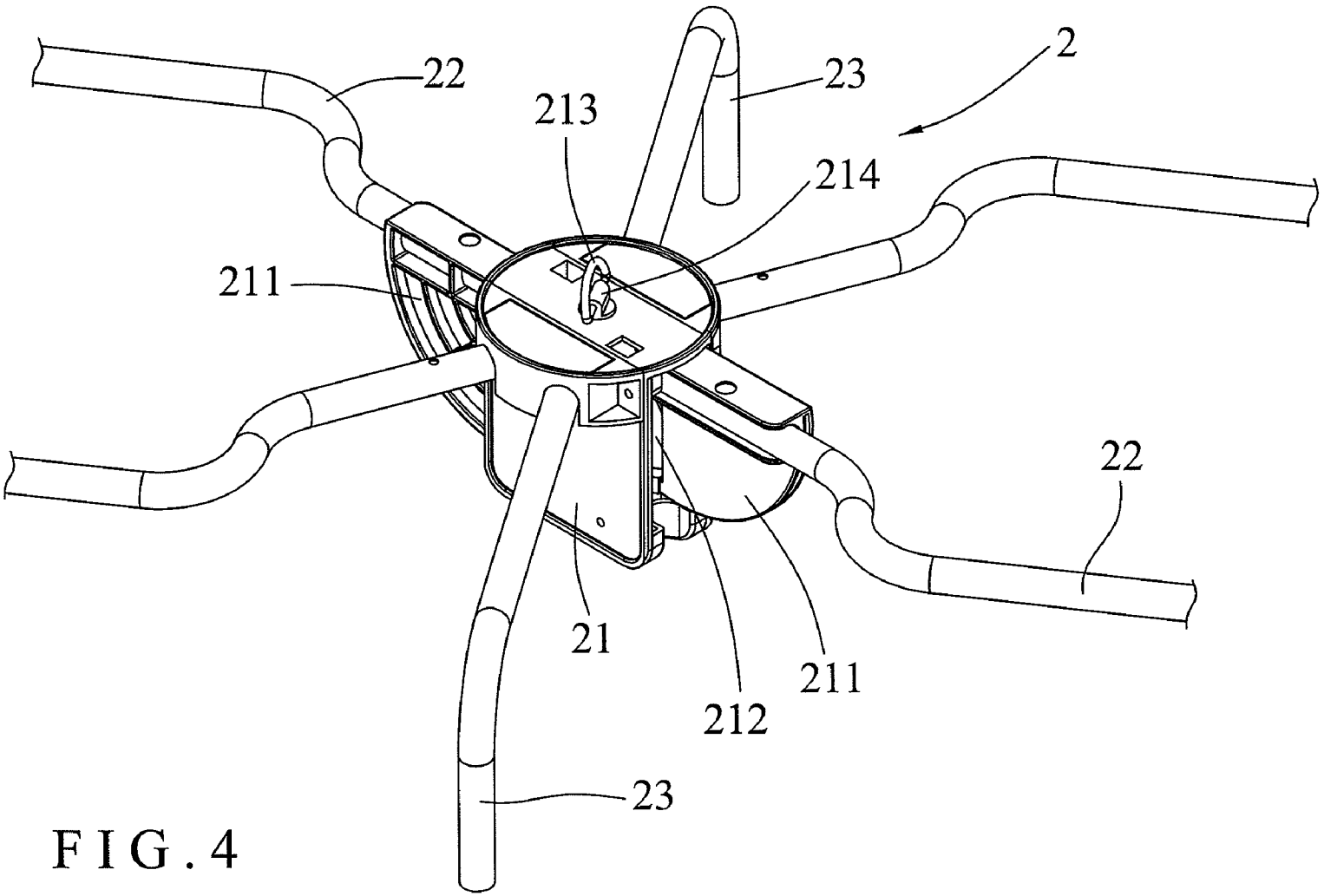
FIG. 4 is a perspective view of a bottom frame of the playpen as shown in FIG. 1.
Figure 5:
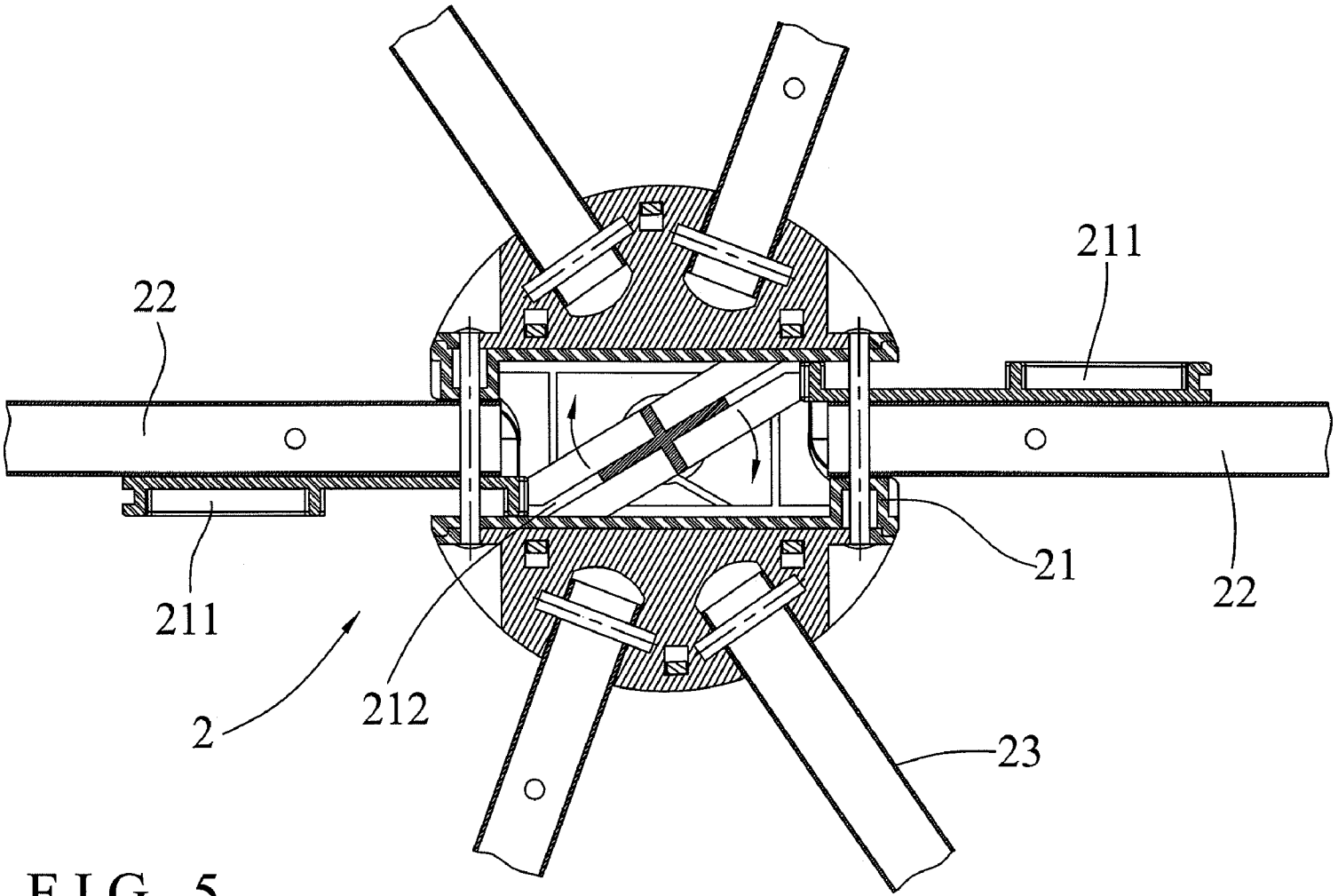
FIG. 5 is a top cross-sectional view of the bottom frame of the playpen as shown in FIG. 4.
Figure 6:
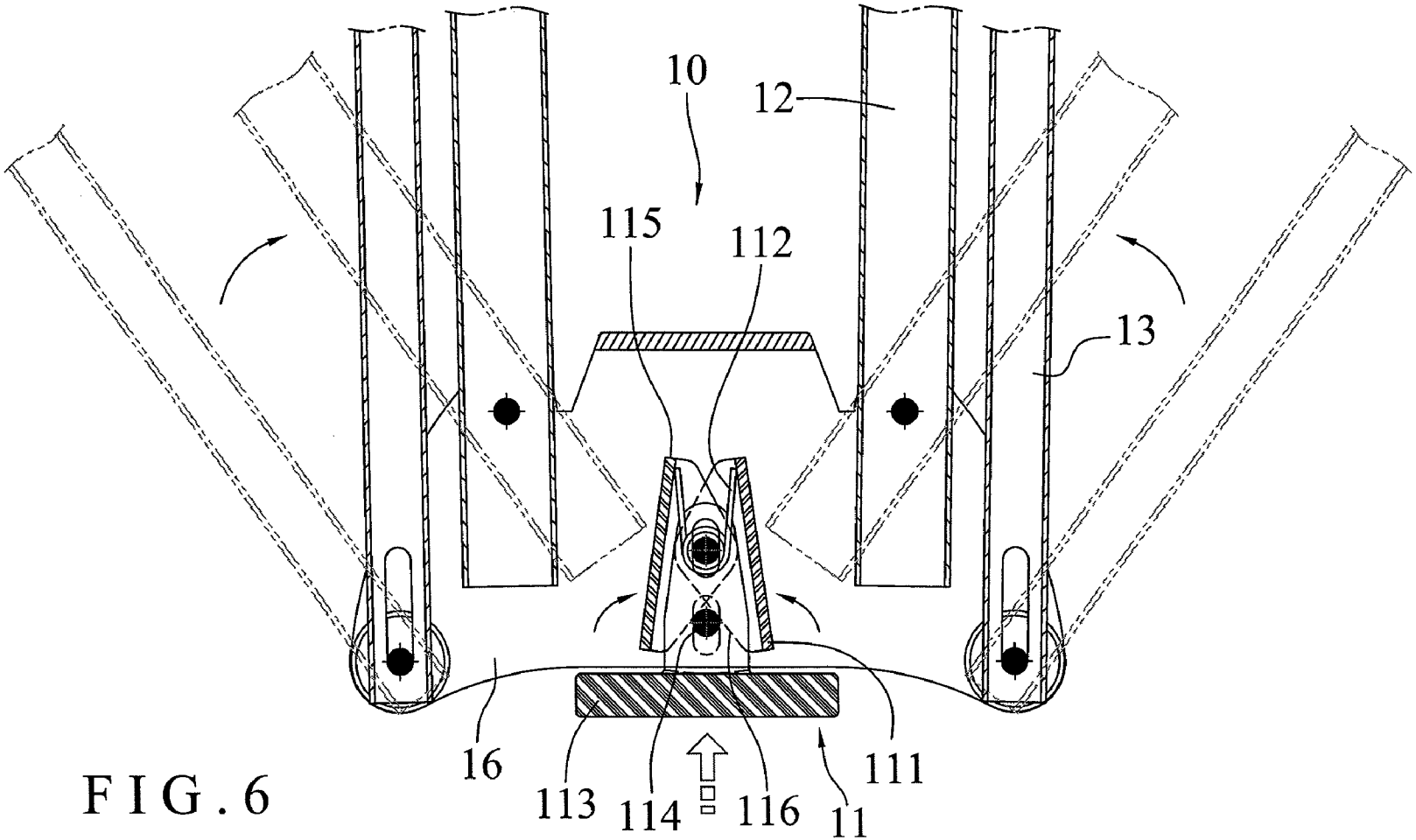
FIG. 6 is a schematic operational view of the playpen as shown in FIG. 3.
Figure 7:
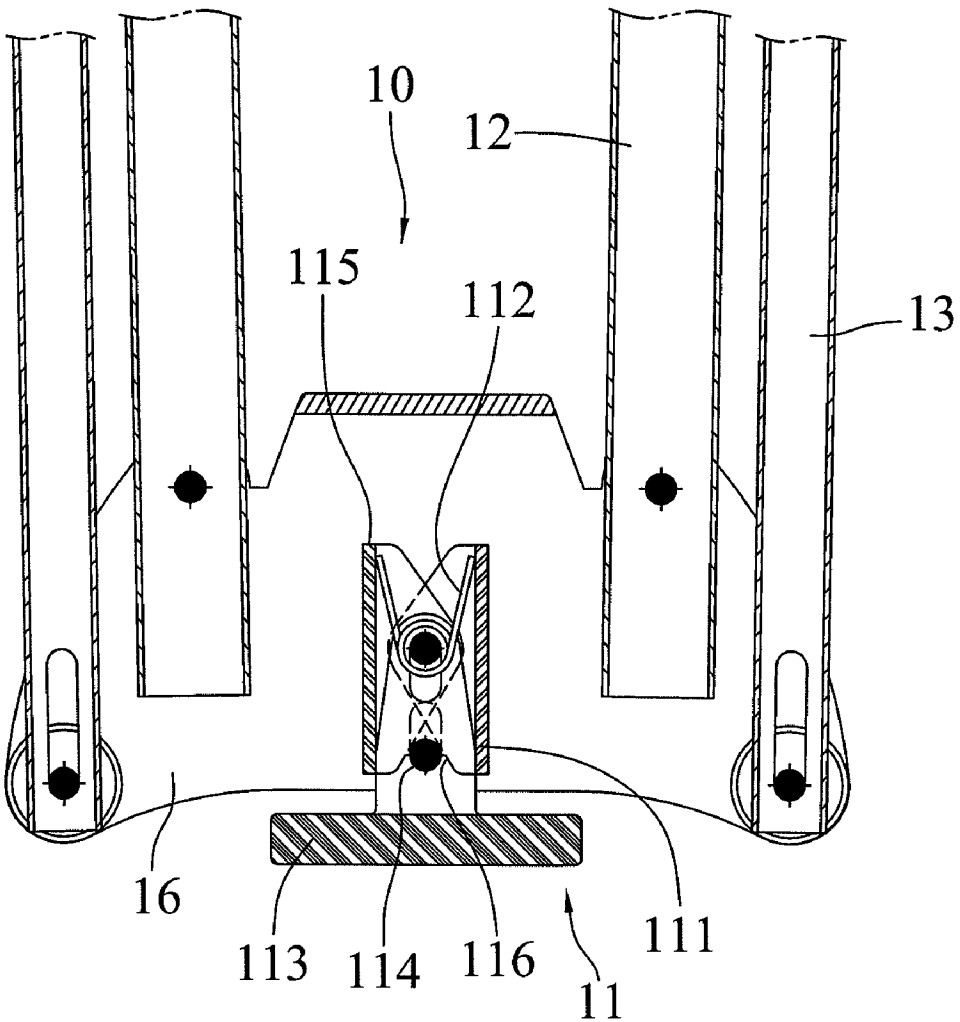
FIG. 7 is a schematic operational view of the playpen as shown in FIG. 6.

In operation, referring to FIGS. 3-9 with reference to FIGS. 1 and 2, the first end 115 of each of the two locking members 111 is rested on the respective main rod 12 as shown in FIG. 3 so that each of the two main rods 12 is secured to the mounting seat 16 by the two locking members 111. When the press button 113 is pressed upward, the push member 114 is moved upward to push the second end 116 of each of the two locking members 111. In such manner, the second ends 116 of the two locking members 111 are pushed by the push member 114 to move outward relative to each other, so that the first ends 115 of the two locking members 111 are moved inward relative to each other to detach from the main rods 12 as shown in FIG. 6. At this time, the elastic member 112 is compressed by the first ends 115 of the two locking members 111. Thus, the two main rods 12 are released from the two locking members 111 and can be pivoted relative to the mounting seat 16, while the auxiliary rods 13 can be pivoted relative to the mounting seat 16. Then, the main rods 12 are pivoted upward relative to the mounting seat 16, and the auxiliary rods 13 are also pivoted upward relative to the mounting seat 16, thereby folding each of the foldable articulations 10 of the top frame 1 as shown in FIG. 7. At this time, the first ends 115 of the locking members 111 are pushed by the elastic member 112 to move outward relative to each other, thereby pivoting and restoring the two locking members 111 to the original position.

Figure 8:
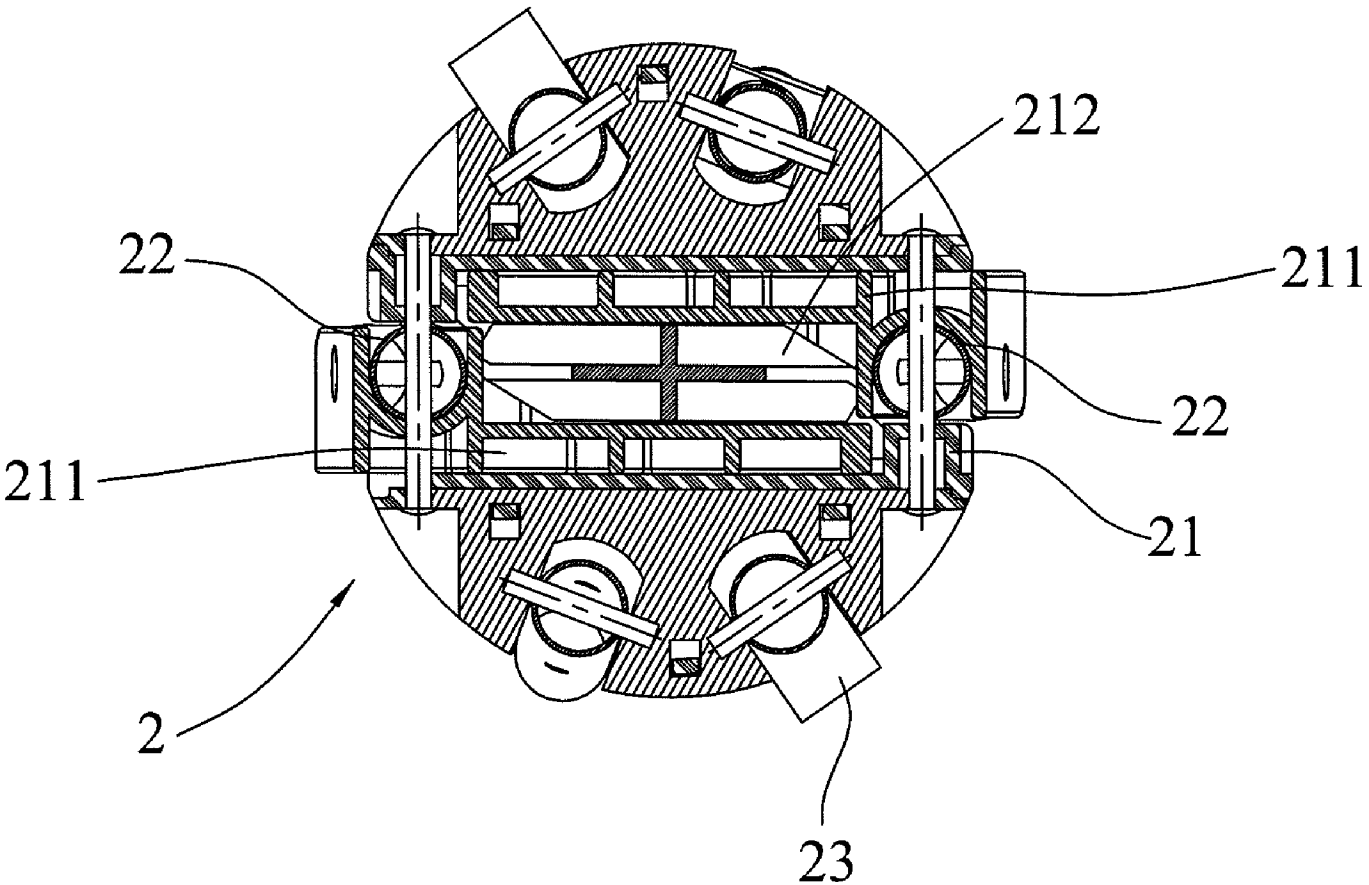
FIG. 8 is a schematic operational view of the playpen as shown in FIG. 5.
Figure 9:
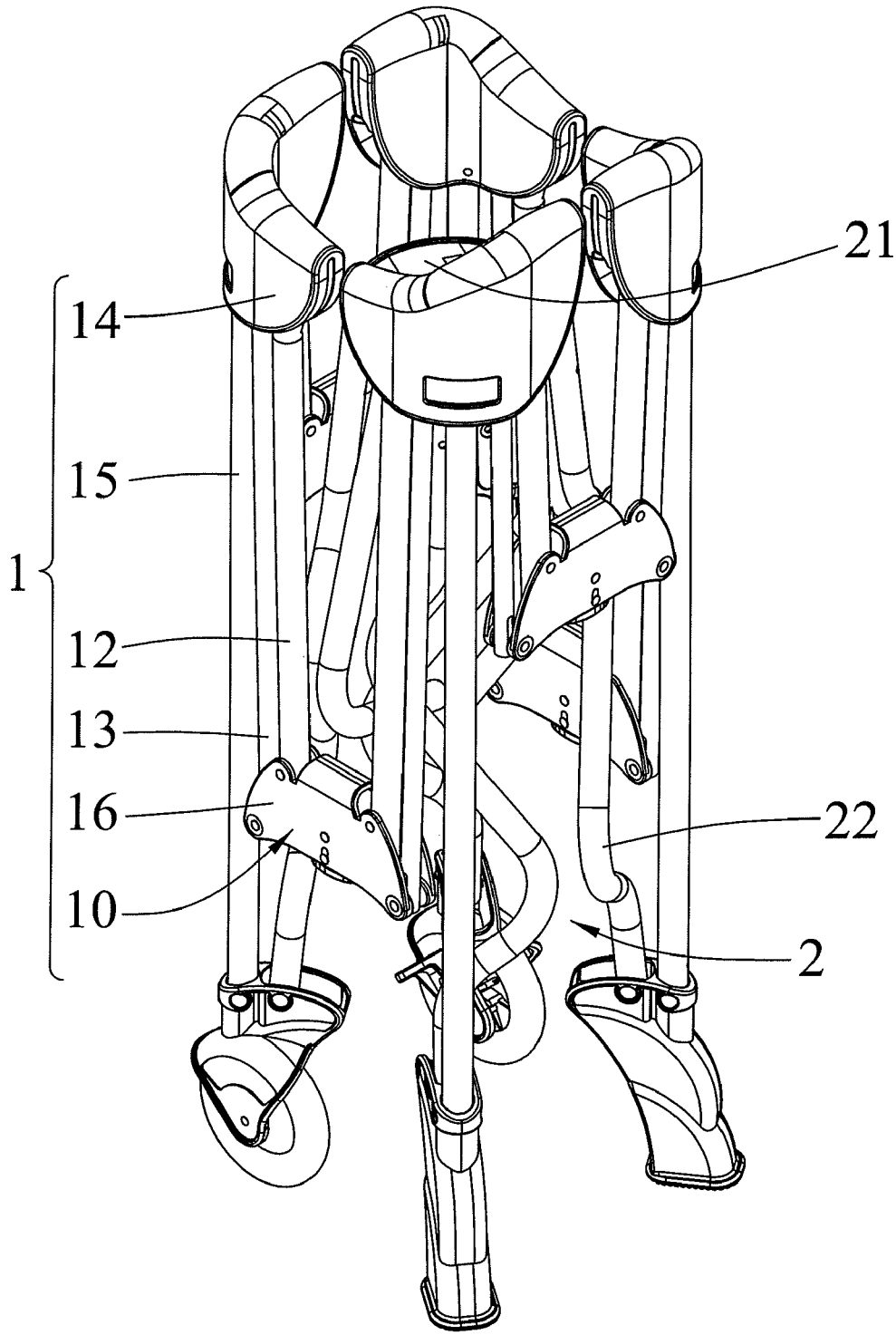
FIG. 9 is a perspective folded view of the playpen as shown in FIG. 1.

On the other hand, the two opposite ends of the rotation seat 212 abut the fixing plates 211 as shown in FIG. 5 to position the fixing plates 211 on the support seat 21 as shown in FIG. 4. When the rotation seat 212 is driven by the pull tab 213 to rotate relative to the support seat 21, the two opposite ends of the rotation seat 212 are moved to detach from the fixing plates 211 as shown in FIG. 8 to release the fixing plates 211 from the support seat 21 so that the fixing plates 211 are pivoted relative to and folded into the support seat 21. In such a manner, the bottom bars 22 and the support bars 23 of the bottom frame 2 are pivoted relative to and folded onto the support seat 21 so as to fold the bottom frame 2. Thus, the top frame 1 is folded downward by pushing each of the foldable articulations 10 downward, and the bottom frame 2 is folded upward by pulling the pull tab 213 upward so as to fold the playpen as shown in FIG. 9.

Accordingly, each of the main rods 12, the respective auxiliary rods 13, the mounting seat 16 of each of the foldable articulations 10 and the respective corner connector 14 form a substantially parallelogram or trapezium linkage so as to reinforce the structural strength of the top frame 1 and to enhance the lifetime of the top frame 1. In addition, the mounting seat 16 of each of the foldable articulations 10 is supported by the main rods 12 and the auxiliary rods 13, so that each of the foldable articulations 10 of the top frame 1 is operated exactly and smoothly to facilitate a user expanding and folding the top frame 1. Further, the side support rods 15 are supported solidly and stably by the main rods 12 and the auxiliary rods 13 of each of the foldable articulations 10 so that the side support rods 15 will not be inclined or tilted to prevent the playpen from being collapsed or upset.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A playpen, comprising:
a top frame including:
four corner connectors;
four foldable articulations mounted between the corner connectors respectively;
each of the four foldable articulations including:
a mounting seat disposed between any two of the corner connectors;
two main rods each having a first end pivotally connected with the mounting seat and a second end pivotally connected with a respective one of the corner connectors;
two auxiliary rods each having a first end pivotally connected with the mounting seat and a second end pivotally connected with a respective one of the corner connectors.

2. The playpen of claim 1, wherein each of the auxiliary rods of each of the foldable articulations is parallel with a respective one of the main rods.

3. The playpen of claim 2, wherein each of the main rods, the respective auxiliary rods, the mounting seat of each of the foldable articulations and the respective corner connector form a substantially parallelogram linkage.

4. The playpen of claim 2, wherein each of the main rods, the respective auxiliary rods, the mounting seat of each of the foldable articulations and the respective corner connector form a substantially trapezium linkage.

5. The playpen of claim 1, wherein each of the auxiliary rods of each of the foldable articulations is located under a respective one of the main rods.

6. The playpen of claim 1, wherein each of the main rods of each of the foldable articulations is located at a top of the mounting seat;

each of the auxiliary rods of each of the foldable articulations is located at a bottom of the mounting seat.

7. The playpen of claim 1, wherein the top frame further includes:

four side support rods each having an upper end mounted on a respective one of the corner connectors.

* * * * *